US010357348B2

(12) United States Patent
Leevy et al.

(10) Patent No.: US 10,357,348 B2
(45) Date of Patent: Jul. 23, 2019

(54) FLUID MANIFOLD

(71) Applicants: Warren Matthew Leevy, Granger, IN (US); Anthony Van Avermaete, South Bend, IN (US); Ian Sander, South Bend, IN (US); Nathan Higgins, St. Marys, PA (US)

(72) Inventors: Warren Matthew Leevy, Granger, IN (US); Anthony Van Avermaete, South Bend, IN (US); Ian Sander, South Bend, IN (US); Nathan Higgins, St. Marys, PA (US)

( * ) Notice: Subject to any disclaimer, the term of this patent is extended or adjusted under 35 U.S.C. 154(b) by 334 days.

(21) Appl. No.: 14/461,655

(22) Filed: Aug. 18, 2014

(65) Prior Publication Data

US 2015/0047724 A1 Feb. 19, 2015

Related U.S. Application Data

(60) Provisional application No. 61/867,405, filed on Aug. 19, 2013.

(51) Int. Cl.
*A61D 7/04* (2006.01)
*F17D 1/04* (2006.01)

(52) U.S. Cl.
CPC ..... *A61D 7/04* (2013.01); *F17D 1/04* (2013.01); *Y10T 137/85938* (2015.04)

(58) Field of Classification Search
CPC .... A61D 7/04; A61D 7/00; F17D 1/04; F17D 1/00; F17D 1/02; Y10T 137/85938; Y10T 137/8593
USPC ..... 128/200.24
See application file for complete search history.

(56) References Cited

U.S. PATENT DOCUMENTS

| | | | | |
|---|---|---|---|---|
| 4,479,493 | A * | 10/1984 | Bung | A61D 7/04 119/420 |
| 4,520,808 | A | 6/1985 | LaBauve | |
| 4,721,060 | A | 1/1988 | Cannon | |
| 5,099,792 | A | 3/1992 | Cannon | |
| 5,297,502 | A | 3/1994 | Jaeger | |
| 5,626,130 | A | 5/1997 | Vincent | |
| 5,896,829 | A | 4/1999 | Barnett | |
| 6,776,158 | B1 | 8/2004 | Anderson | |

(Continued)

FOREIGN PATENT DOCUMENTS

| | | |
|---|---|---|
| WO | 1999/017678 | 4/1999 |
| WO | 1999/043389 | 9/1999 |
| WO | 2003/079924 | 10/2003 |

*Primary Examiner* — Jan Christopher L Merene
*Assistant Examiner* — Elliot S Ruddie
(74) *Attorney, Agent, or Firm* — Notre Dame Intellectual Property Clinic

(57) ABSTRACT

A fluid manifold that consistently and reliably delivers fluids to one or more subject interfaces is provided. A branched pattern of bifurcated lumina carrying the fluid from a source to the outlets in each subject interface provides substantially equal amounts of fluid to each subject interface, thereby reducing the risk of over- or under-delivery of the fluid. A fluid-scavenging system is also included. A plurality of exhaust inlets in the interior of the subject interfaces is connected to a source of negative pressure through a channel and exhaust port to collect fluid before it can escape the subject interface, thereby reducing the risk of escaping fluid reaching the atmosphere.

15 Claims, 14 Drawing Sheets

(56) References Cited

U.S. PATENT DOCUMENTS

| | | | | |
|---|---|---|---|---|
| 6,782,845 | B1 * | 8/2004 | Schmidt | A01K 1/031 119/419 |
| 7,326,188 | B1 | 2/2008 | Russell | |
| 7,464,707 | B2 * | 12/2008 | Dalgetty | A01K 1/031 128/203.12 |
| 7,503,323 | B2 | 3/2009 | Dalgetty | |
| 7,594,481 | B2 * | 9/2009 | Carter | A01K 1/031 119/418 |
| 7,688,530 | B1 * | 3/2010 | Aeschbach | G02B 7/004 359/811 |
| 7,806,082 | B2 | 10/2010 | Dalgetty | |
| 8,161,631 | B1 * | 4/2012 | Ledbetter | H02B 3/00 200/50.21 |
| 8,196,574 | B2 | 6/2012 | Ichikawa | |
| 2004/0216737 | A1 | 11/2004 | Anderson | |
| 2006/0254528 | A1 * | 11/2006 | Malnati | A01K 1/031 119/419 |
| 2006/0275185 | A1 * | 12/2006 | Tonkovich | B01J 19/0093 422/130 |
| 2007/0293423 | A1 * | 12/2007 | Jungheim | A61K 47/22 549/429 |
| 2014/0339715 | A1 * | 11/2014 | Collins | B01F 5/0212 261/23.1 |

* cited by examiner

FLUID MANIFOLD

CROSS-REFERENCE TO RELATED APPLICATIONS

This application claims the benefit of the filing date of U.S. provisional patent application Ser. No. 61/867,405, filed on Aug. 19, 2013, entitled "Anesthesia Manifold for Equal Delivery and Scavenging of Isoflurane to Mice and Rats," the disclosure of which is incorporated herein by reference.

BACKGROUND

There are many fields where there is a need for the delivery of a fluid or vapor to an animal. Two important applications are in veterinary procedures, and research settings. Often in research, for example, it would be beneficial to sedate multiple laboratory animals at once; this is especially true in the field of preclinical optical imaging where a control cohort is compared to an experimental cohort. This multiple animal sedation is currently achieved in a number of ways, most commonly focusing on the delivery of the gaseous anesthetic to the nose or mouth of the lab animals through a bulky deployment chamber and individual nose-cones. A pump forces an anesthetic from a source to the inlet of a manifold. The inlet leads to a chamber with several outlets which can be fitted with external nose-cones. The laboratory animals are positioned with their noses propped in these cones so that as they breathe, they inhale the anesthetic gas.

The fluid or vapors inevitably escape from the nose-cones, and leak into the atmosphere, which poses health concerns for those working with these systems and the environment. Currently, several methods exist for reducing or eliminating the escape of gases from these apparatuses. One method involves completely enclosing the laboratory animals in an air-tight chamber attached to a vacuum line and gas trap; but this design requires more space, is more traumatic for the animals, and can limit the techniques which can be used to image the enclosed animal. A second method involves scavenging fluid after it has escaped the subject interface, such as by positioning inlets exterior to the outermost lip of the nose-cones. These inlets are routed to a vacuum line and gas trap and thus scavenge a portion of the excess gas that has diffused outside the subject interface.

BRIEF SUMMARY

The following presents a simplified summary in order to provide a basic understanding of some aspects of the claimed subject matter. This summary is not an extensive overview. It is not intended to either identify key or critical elements or to delineate the scope of the claimed subject matter. Its sole purpose is to present some concepts in a simplified form as a prelude to the more detailed description that is presented later.

In embodiments, a fluid delivery device for providing a fluid to at least one subject, comprises a receiving port that directs said fluid into said body member, at least three subject interfaces, each having at least one outlet for discharging the fluid, and a plurality of successively bifurcated lumina connecting said receiving port to said outlets wherein the plurality of lumina are substantially equal in dimensions. In embodiments, said bifurcated lumina rejoin via at least one reconnection point.

In another embodiment, a fluid delivery device for providing a fluid to a subject comprises a body member that comprises a receiving port for directing fluid into said body member, a lumen connected to said receiving port, a subject interface, wherein said subject interface is a cavity within the body member for receiving at least a portion of said subject and exposing said subject to the fluid, and wherein said lumen carries the fluid from said receiving port to said subject interface, at least one exhaust inlet for collecting the fluid from said subject interface, wherein said at least one exhaust inlet is disposed within said subject interface, a channel connected to said at least one exhaust inlet; and an exhaust port for removing fluid wherein said exhaust port is attached to said body member and said channel carries the fluid from said at least one exhaust inlet to said exhaust port. In embodiment, the fluid delivery device comprises a diffuser interposed between said lumen and said subject interface.

The fluid delivery device comprises a body member with one or more subject interfaces. Each subject interface has an outlet and exhaust inlets in the interior of the subject interface. The body member has a base; the base is sufficiently flat for abutting a planar work surface. The base of the body member has a cavity for affixedly receiving a magnet. The body member has a slot between adjacent subject interfaces which can removably receive and retain a divider. The divider is a plate with a thickness equal to the width of the slot.

A receiving port on the body member directs a fluid into the body member, and a plurality of successively bifurcated lumina connects the receiving port to the outlets in the subject interfaces. The segments after each bifurcation are equally-dimensioned. In embodiments, adjacent segments of adjacent bifurcations join into a single segment. An exhaust port on the body member is in fluid communication with the exhaust inlets via a channel in the body member.

To accomplish the foregoing and related ends, certain illustrative aspects of the claimed subject matter are described herein in connection with the following description and the annexed drawings. These aspects are indicative of various ways in which the subject matter may be practiced, all of which are intended to be within the scope of the claimed subject matter. Other advantages and novel features may become apparent from the following detailed description when considered in conjunction with the drawings.

A BRIEF DESCRIPTION OF THE DRAWINGS

The systems, devices and methods may be better understood by referring to the following description in conjunction with the accompanying drawings, in which like numerals indicate like structural elements and features in various figures. The components in the figures are not necessarily to scale, and simply illustrate the principles of the systems, devices and methods. The accompanying drawings illustrate only possible embodiments of the systems, devices and methods and are therefore not to be considered limiting in scope.

FIG. 1*a* shows a perspective view of an embodiment of a manifold with five subject interfaces.

FIG. 1*b* shows an alternate perspective view of the same embodiment of FIG. 1*a*.

FIG. 1*c* shows a bottom view of the same embodiment of FIG. 1*a*.

FIG. 2*a* shows an exploded view of another embodiment of a manifold with five subject interfaces.

FIG. 2*b* shows a cross-section view of a cut-away along plane I of the embodiment of FIG. 2*a*.

FIG. 2*c* shows an orthogonal view of the embodiment of FIG. 2*a*.

FIG. 2*d* shows a perspective view of the embodiment of FIG. 2*a*.

FIG. 3*a* shows a schematic representation of a bifurcated pattern of lumina for embodiments of a manifold with an even number of subject interfaces.

FIG. 3*b* shows a schematic representation of a bifurcated and rejoining pattern of lumina for an embodiment of a manifold with an odd number of subject interfaces.

FIG. 3*c* shows a perspective view of an arrangement of lumina in an embodiment of a manifold with five subject interfaces.

FIG. 3*d* shows an alternate perspective view of an arrangement of lumina shown in FIG. 3*c*.

Figure 6A:
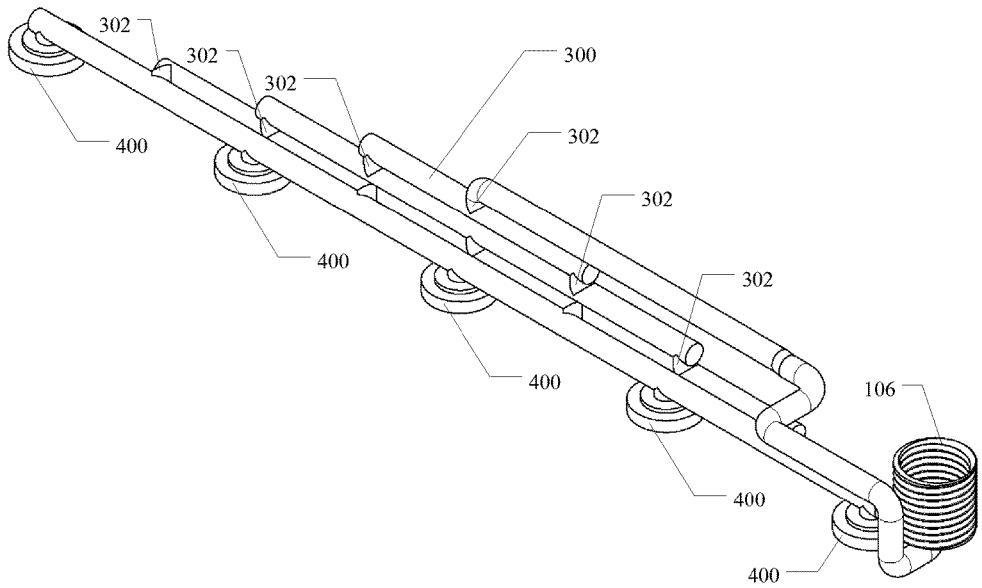

FIG. 6*a* shows a perspective view of an arrangement of lumina in an embodiment of a manifold with five subject interfaces.

Figure 6B:
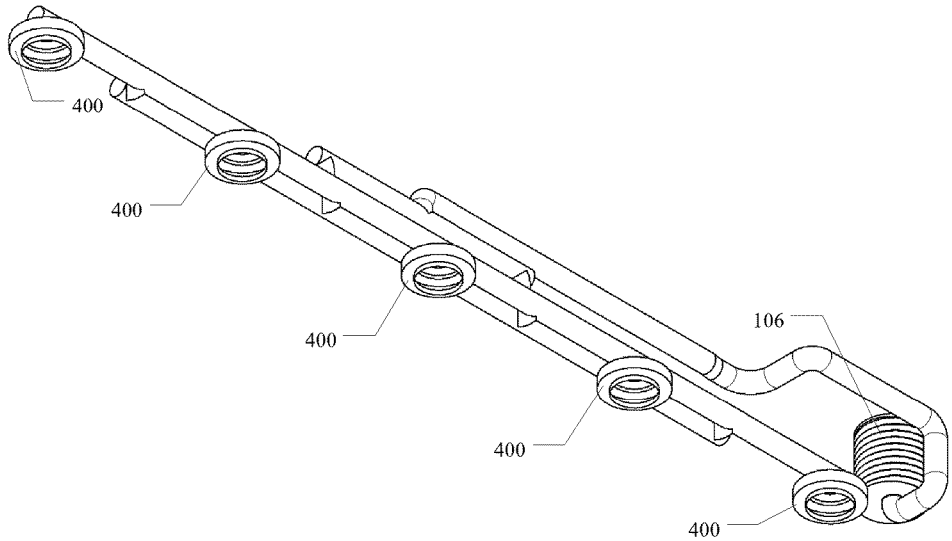

FIG. 6*b* shows an alternate perspective view of an arrangement of lumina in an embodiment of a manifold with five subject interfaces.

Figure 6C:
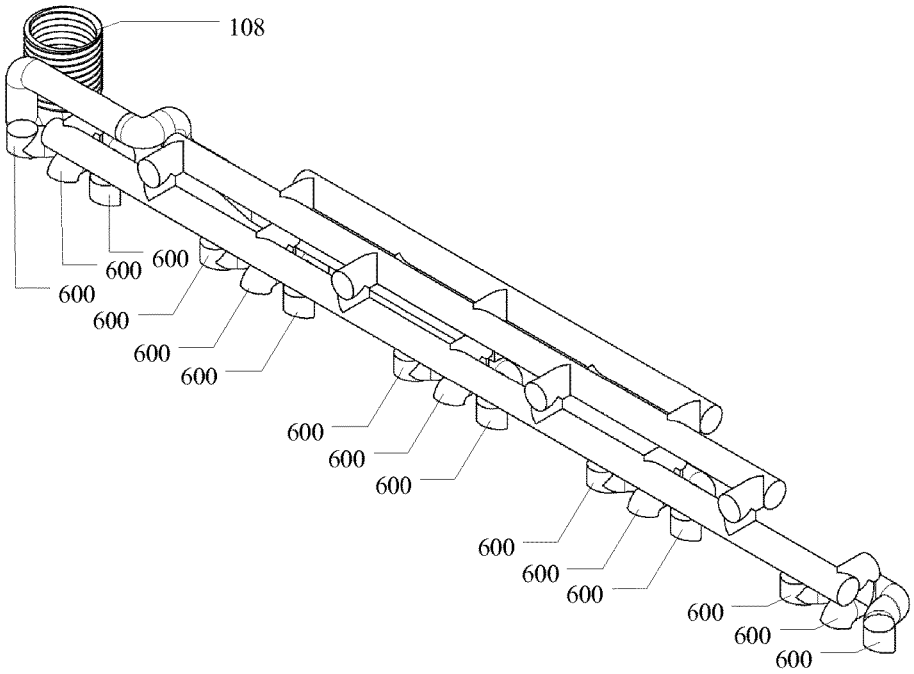

FIG. 6*c* shows a perspective view of an arrangement of sub-channels in an embodiment of a manifold with five subject interfaces.

Figure 6D:
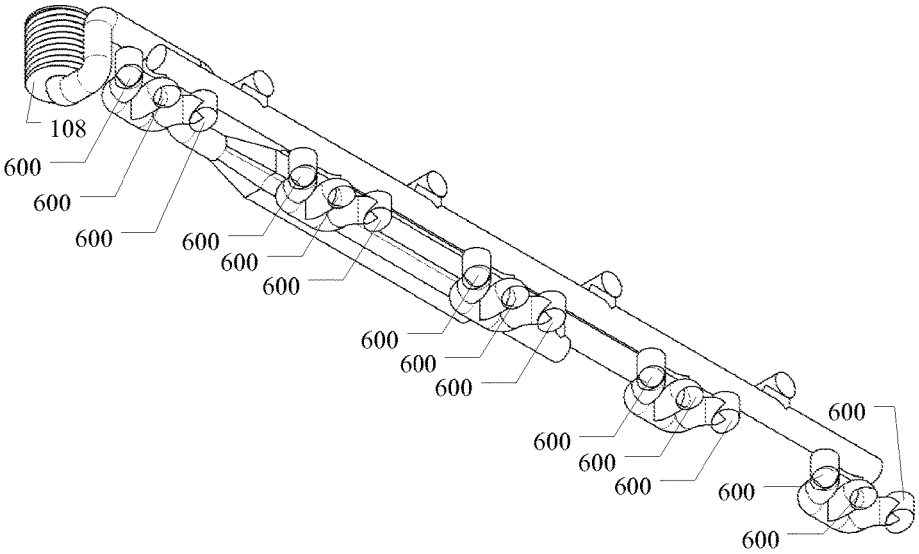

FIG. 6*d* shows an alternate perspective view of an arrangement of sub-channels in an embodiment of a manifold with five subject interfaces.

Figure 6E:
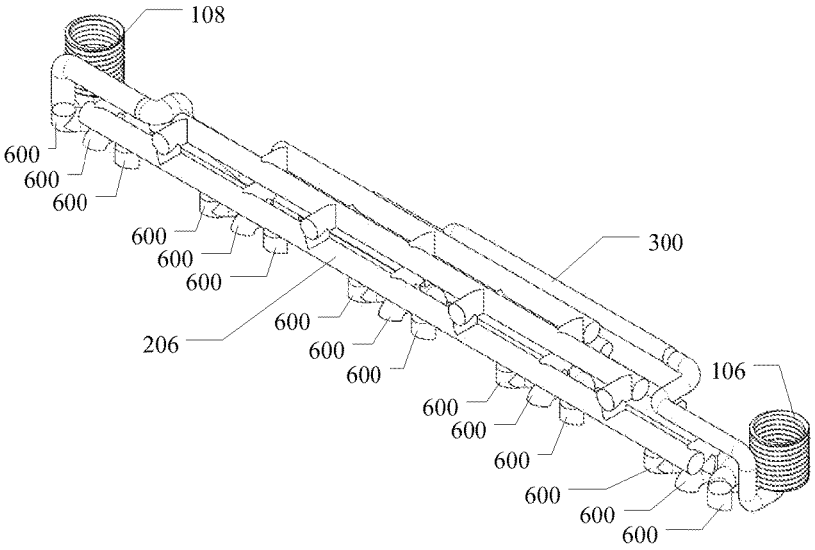

FIG. 6*e* shows a perspective view of an arrangement of lumina and sub-channels in an embodiment of a manifold with five subject interfaces.

Figure 6F:
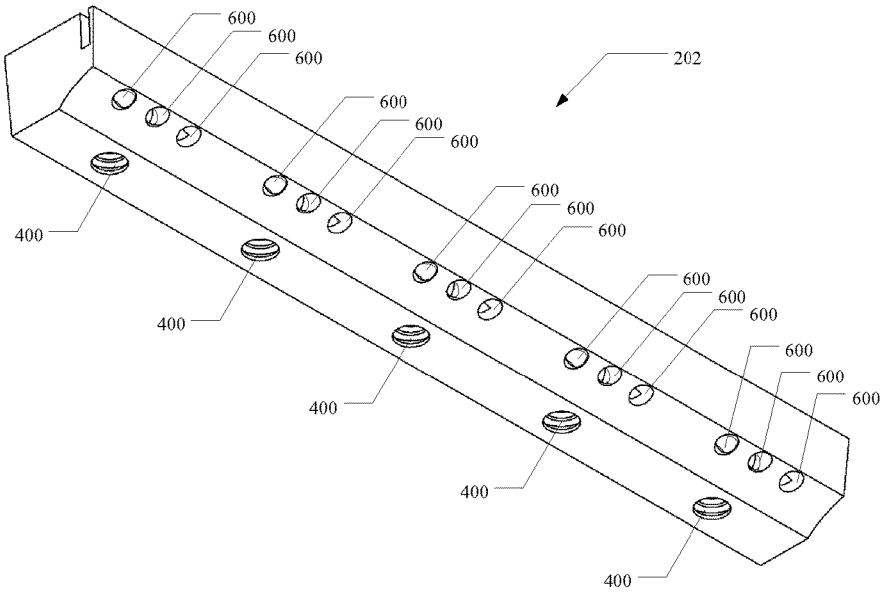

FIG. 6*f* shows a perspective of an embodiment of the core.

Figure 7:
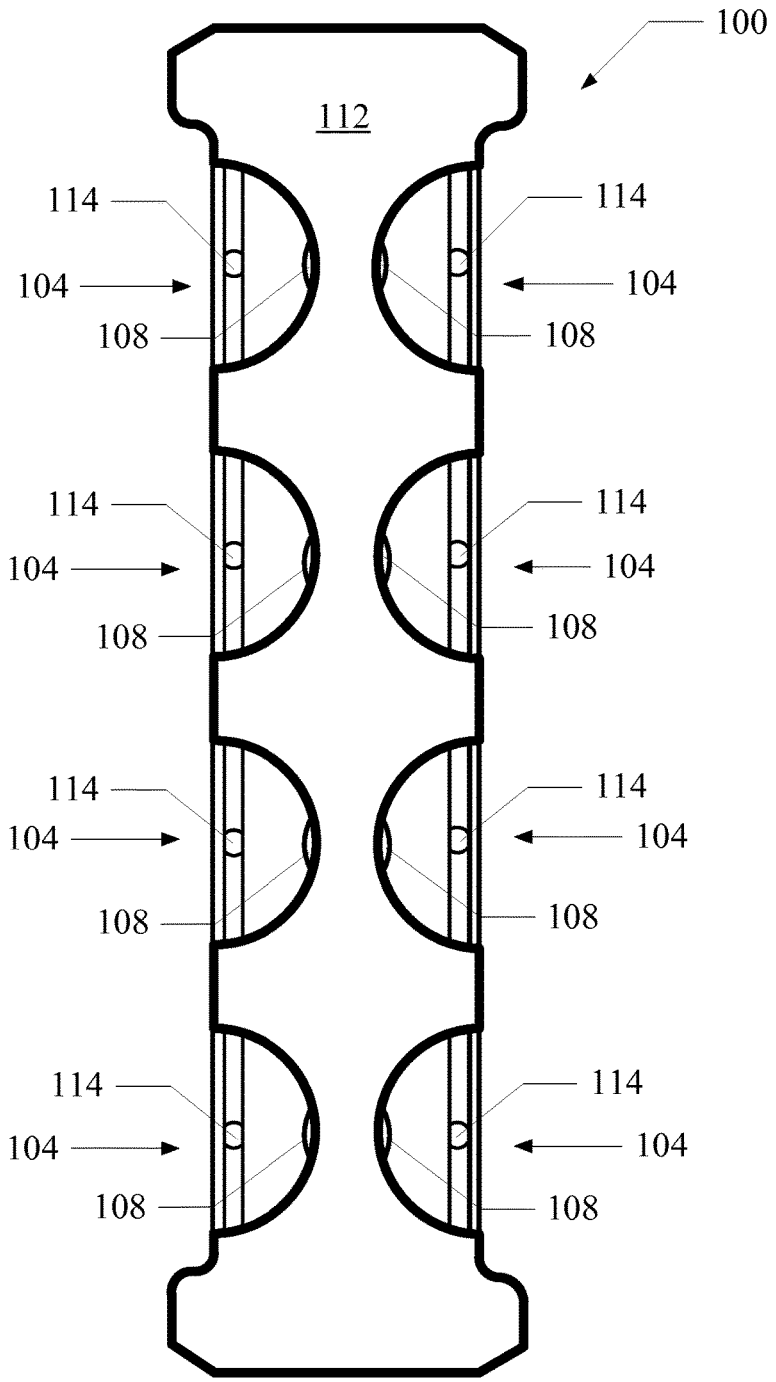

FIG. 7 shows a bottom view of an embodiment of a manifold with four subject interfaces on each side of the body member.

Figure 8:
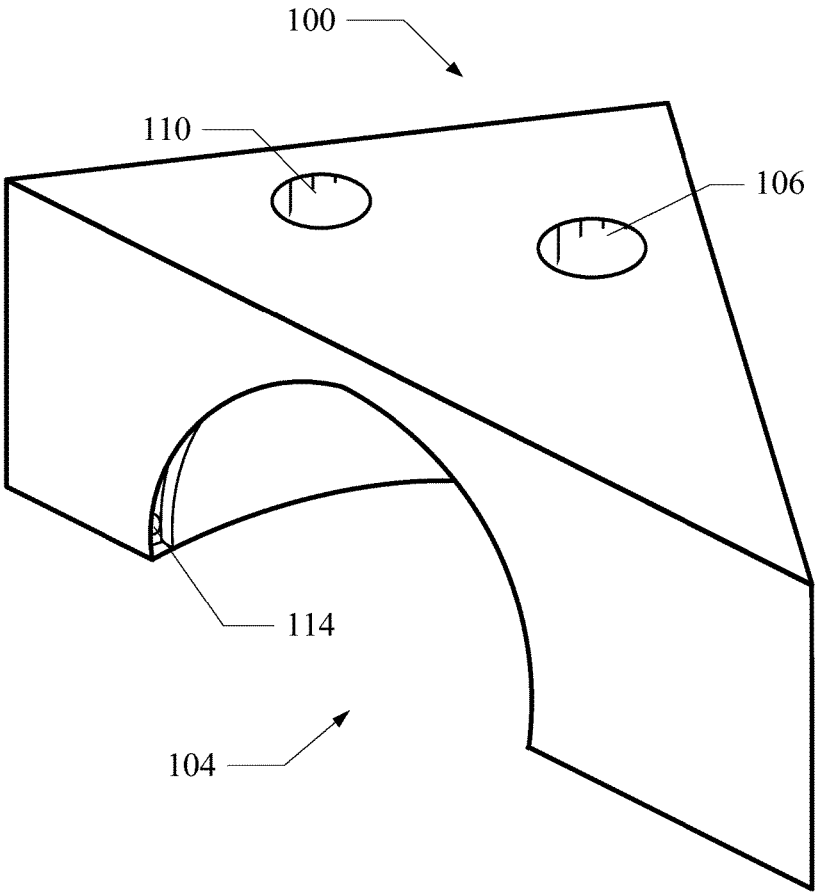

FIG. 8 shows a perspective view of an embodiment of a manifold with one subject interface with a triangular body member.

Figure 9:
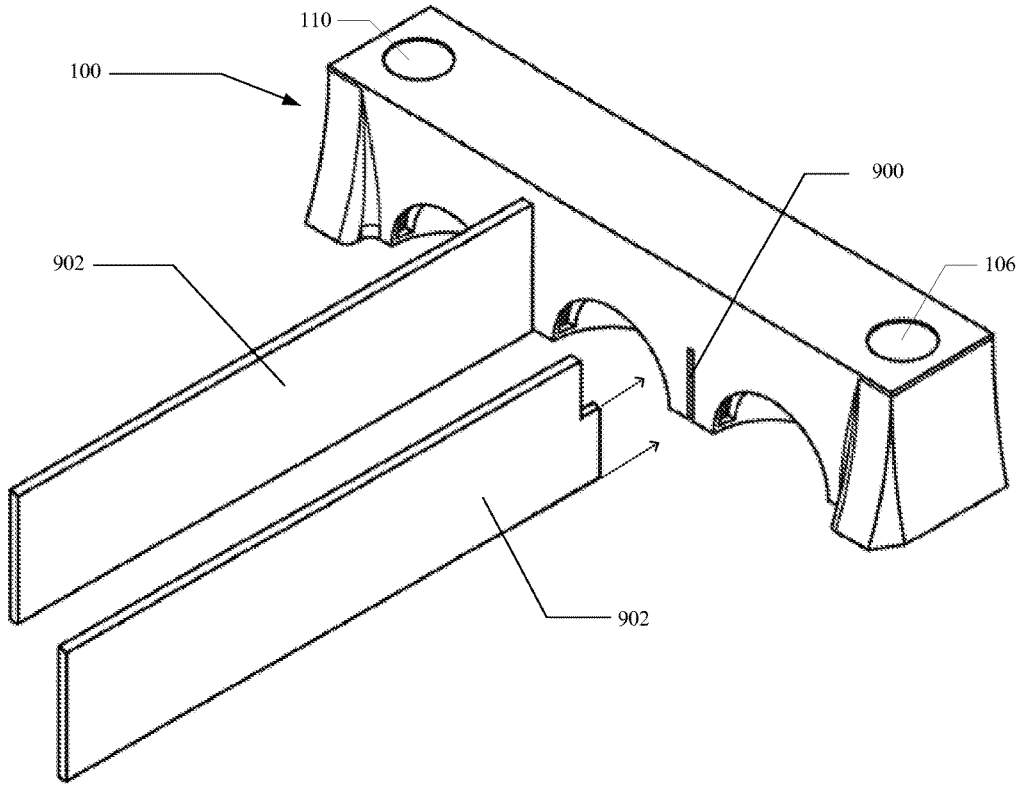

FIG. 9 shows a perspective view of an embodiment of a manifold with three subject interfaces and removable dividers.

Figure 10:
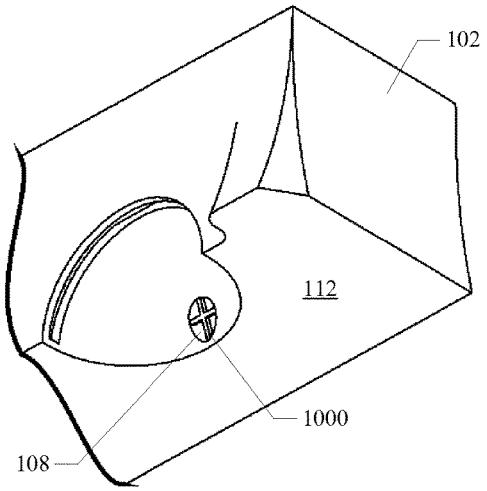

FIG. 10 shows a perspective view of an embodiment of a manifold with a baffle in the outlet.

DETAILED DESCRIPTION

Aspects of the system and methods are described below with reference to illustrative embodiments. The references to illustrative embodiments below are not made to limit the scope of the claimed subject matter. Instead, illustrative embodiments are used to aid in the description of various aspects of the systems and methods. The description, made by way of example and reference to illustrative reference is not meant to being limiting as regards any aspect of the claimed subject matter.

Embodiments of the manifolds described herein can be used in conjunction with existing sources of fluids and negative pressure to evenly distribute a fluid, or mixture of fluids, to one or more subjects. As used herein, "fluid" refers to a gas, vapor, liquid, or aerosol. In currently available fluid delivery systems, the fluid is urged into a single chamber with outlets or through a trunk and branch arrangement.

These arrangements lead to uneven delivery of the fluid to the different outlets, as each outlet is a different distance from the inlet. When anesthetizing multiple animals, uneven doses of anesthesia can lead to over-sedation or under-sedation of the animals, potentially harming the animal or allowing the animal to waken during imaging and disrupting procedures. Embodiments of the manifold described herein improve distribution of the fluid, such that the animals receive equal or substantially equal amounts of fluid.

In addition, the manifolds described herein can reduce or minimize the escape of excess fluid from the subject interfaces. Escaping fluids can pose health concerns for the animal subjects as well as the human operators. The described manifolds can scavenge the fluid before it leaves the subject interface, thereby reducing the risk of harm to both humans and animal subjects.

In most optical imaging instruments, the amount of functional space is limited; therefore, any obstructions of this space are undesirable. The use of nosecones can increase the amount of functional space taken up by the delivery system. The embodiments of the manifolds described herein utilize a compact and noseconeless design to reduce the bulk and increase the amount of functional space of the imaging instrument that can be utilized.

Figure 1A:
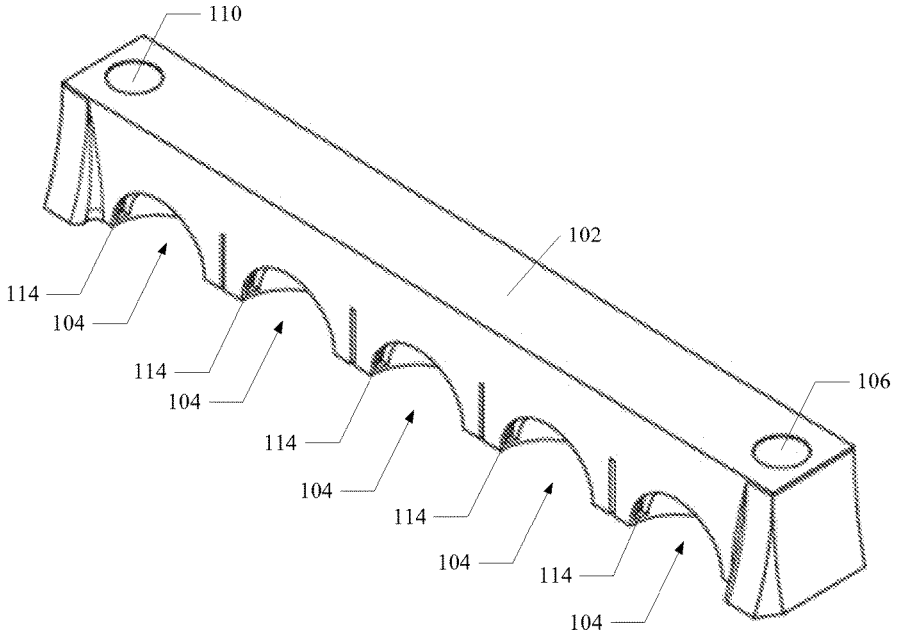

Referring now to FIG. 1*a*, generally, the described manifolds 100 are comprised of a body member 102, a receiving port 106 for directing fluid into the manifold 100, lumina 300 connecting the receiving port 106 to outlets 108 in the subject interfaces 104, exhaust inlets 114 for collecting excess fluid, and a channel 206 connecting the exhaust inlets 114 to an exhaust port 110.

The receiving port 106 can be connected to a source of fluid directly through a hose, through a hose adapter, or other suitable means. Fluid is directed in through the receiving port 106 and into the lumina 300, shown in detail in FIG. 3*a*-3*d* below. The fluid travels through the lumina 300 and is delivered to the subject interfaces 104 through outlets 108 in the interior of the subject interfaces 104. Once the fluid has been delivered to the subject interface 104, it can be inhaled by a subject, for example, a laboratory rat or other animal. The amount of fluid or mixture of fluids can be carefully controlled by external means, including but not limited to, an anesthesia delivery system, a simple valve, or flow regulator.

Located on the interior of the subject interface 104 is at least one exhaust inlet 114 connected to the channel 206. The channel 206 is in fluid communication with the exhaust port 110, which is capable of connecting to a source of negative pressure such as through a hose, or hose adapter. When a negative pressure is applied to the exhaust port 110, fluid is drawn in from the subject interface 104 through the inlets and channel 206 and out of the body member 102. This drawing of fluid through the exhaust inlets 114 will minimize or prevent the fluid from escaping the subject interfaces 104. During operation, if there are fewer subjects than subject interfaces 104, the need to block off unused subject interfaces 104 is eliminated, which is advantageous because blocking an interface would alter the flow to the remaining subject interfaces 104.

In embodiments, the subject interfaces 104 are cavities in the body member 102, sized to receive the nose of the intended subject animal. In the illustrated embodiment, the subject interface 104 intersects the base 112 and an adjacent face of the body member 102, creating an aperture to receive the nose of the subject animal. The work surface on which the body member 102 is placed forms a bottom to the cavity. This design allows the manifold 100 to be placed over, or removed from subject animals without disturbing their position. The cavity design of the subject interface 104 can reduce the amount of functional space of the imaging instrument that is taken up by the manifold 100. Additionally, since the subject interface 104 is a cavity rather than a separate cone, material costs can be reduced.

Figure 1B:
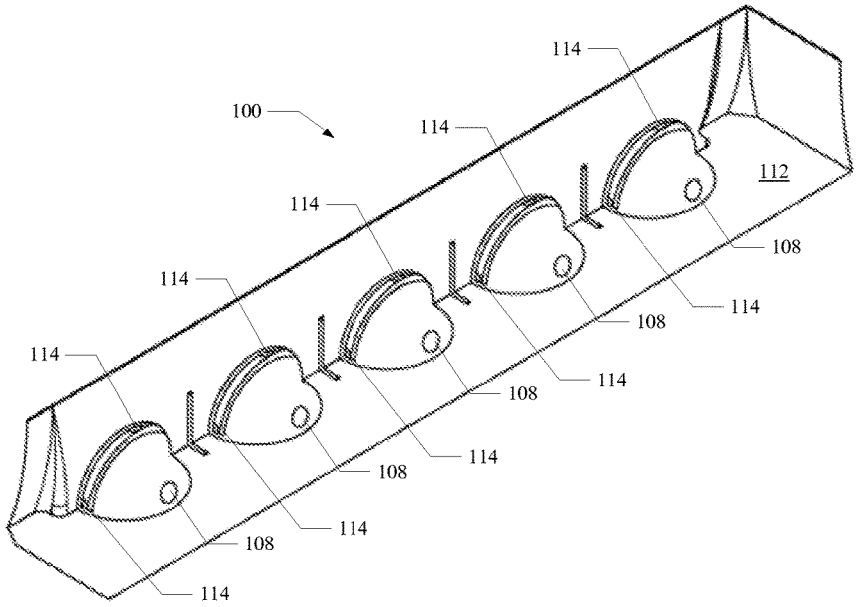
Figure 1C:
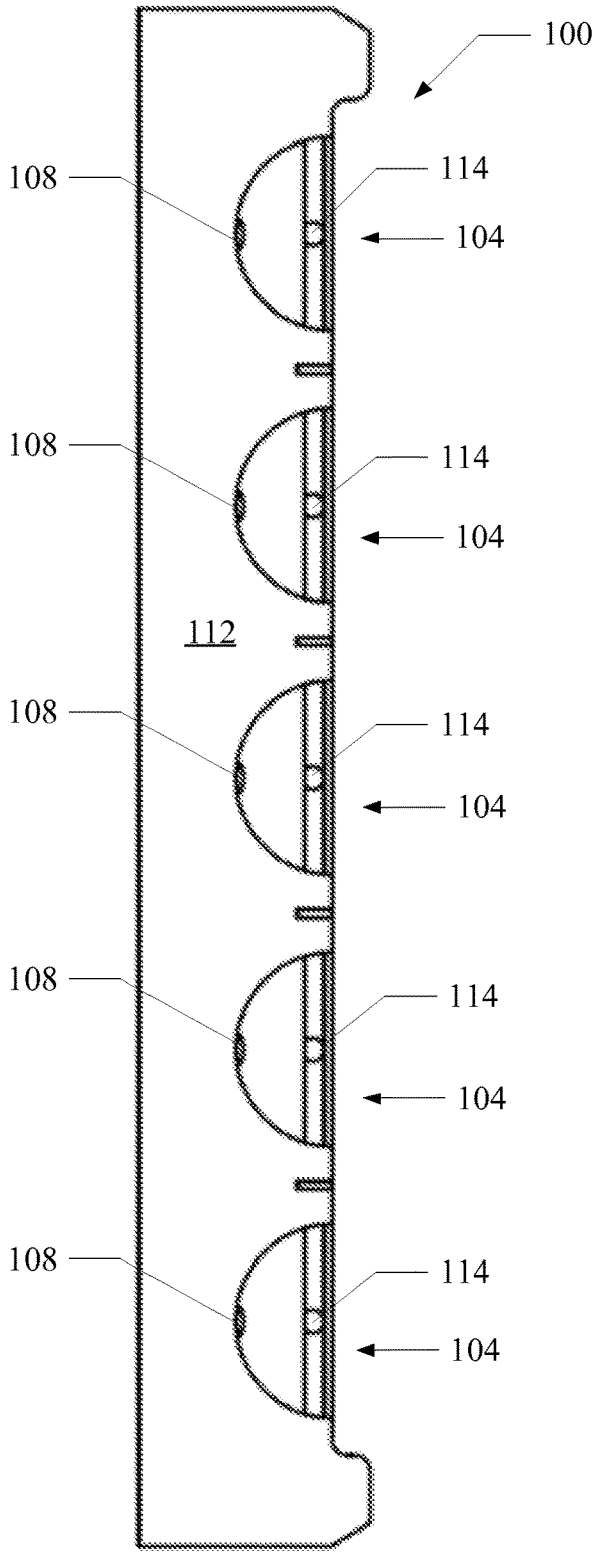

FIGS. 1*a-c* illustrate an embodiment of a manifold 100 with five subject interfaces 104 in the body member 102. FIG. 1*a* provides a perspective top view of the manifold 100. In the illustrated embodiment, the receiving port 106 is located on top of the body member 102 for ease of access. As one skilled in the art will appreciate, the position of the exhaust port 110 can be located on various surfaces of the body member 102 as may be required and/or desired in certain embodiments. Within the body member 102, a series of lumina 300 (explained further in the discussion of FIGS. 3*a-d*) deliver the fluid to the outlets 108 (seen in FIG. 1*b*) in the subject interfaces 104.

Turning to FIG. 1*b*, a perspective bottom view of the same embodiment of a manifold 100 illustrates a possible location for the outlets 108 within the subject interfaces 104. In this illustrative embodiment, three exhaust inlets 114 are spaced approximately evenly at the interior edge of the subject interfaces 104. The base 112 of the body member 102 is substantially flat so that when resting on a flat work surface (e.g. an imaging bed) the base 112 forms a seal with the work surface against fluids escaping under the manifold 100.

Turning to FIG. 1*c*, a bottom view of the same embodiment of a manifold 100 shows the exhaust inlets 114 are located adjacent to the perimeter of the subject interface 104 on the interior surface within a recessed arch. This position captures or scavenges the fluid prior to escape from the subject interface 102 and before dissipation into the atmosphere. As will be understood by one skilled in the art, the size, arrangement and number of exhaust inlets 114 can be modified from what is described herein as may be required and/or desired in certain embodiments. The exhaust inlet 114 is an aperture through the body member 102 to a channel 206 (explained further in the discussion of FIG. 2*b*) formed in the interior of the body member 102 in fluid communication with the exhaust port 110. Returning to FIG. 1*a*, in the illustrated embodiment, the exhaust port 110 is located opposite the base 112 for ease of access. As one skilled in the art will appreciate, the position of the exhaust port 110 can be located on various surfaces of the body member 102 as may be required and/or desired in certain embodiments.

In certain embodiments, the body member 102 can be of a monolithic, solid, construction as with 3D printing or other methods.

Figure 2A:
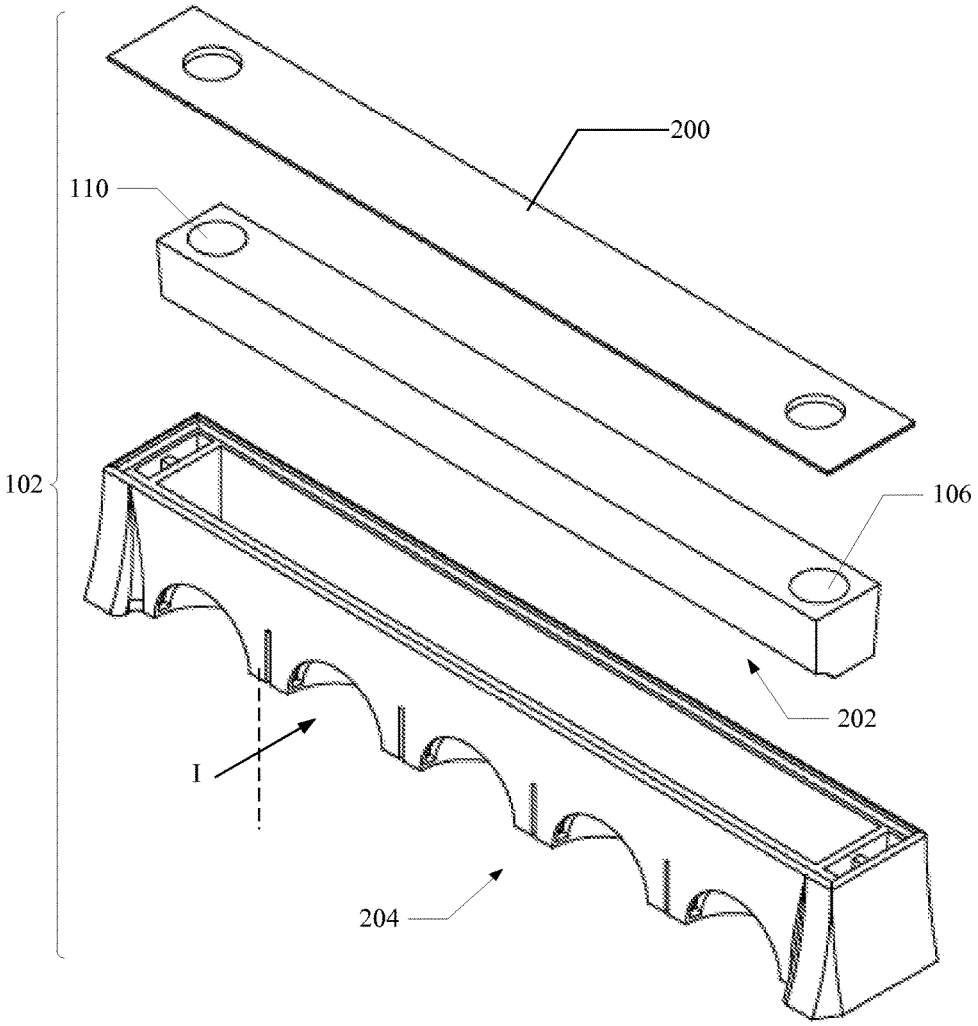

Referring to FIG. 2*a*, in embodiments, the body member 102 can be made of multiple parts fitted together. As illustrated, the body member 102 comprises a lid 200, a core 202, and a shell 204. Production in multiple parts can save production costs by allowing more traditional methods of manufacture, such as injection molding; and allow a wider range of usable materials. Suitable materials for the construction of the manifolds 100 include, but are not limited to, chemically resistant plastics such as polyamides, polypropylene, polyethylene, and acrylics. Different materials may be used for different intended applications. For example, a common anesthetic is isoflurane, which degrades ABS and PLA plastics; accordingly the manifold 100 can be made either in part or entirely of an acrylic or other chemically resistant material to resist chemical deterioration.

In an embodiment, the core 202 fits into the shell 204 and is held in the correct vertical alignment by tapers on the front and back of the core 202 and the inner walls of the shell 204, and a mating surface of the outlet 108. A mating cavity 400, illustrated in FIG. 4, in the lower surface of the core 202 accommodates an O-ring to enhance the seal between the core 202 and the shell 204. The lid 200 can be affixed to the shell 204 with adhesive such as epoxy, or other suitable means including, but not limited to, plastic welding.

Figure 2B:
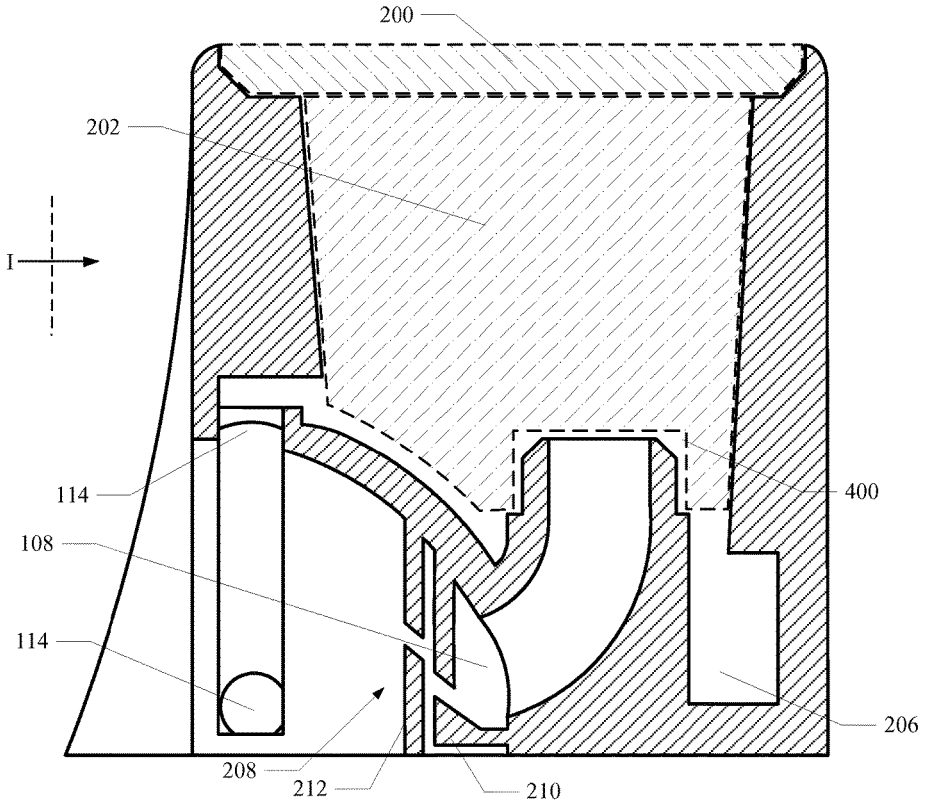

FIG. 2*b* shows a cross-sectional view along I of the shell 204 of FIG. 2*a*. The core 202 is shown in phantom seated in the shell 204, and the lid 200 is shown in phantom seated above the core 202. In the illustrated embodiment, the channel 206 is formed by the interior space of the shell 204 below the core 202. As one skilled in the art will appreciate, the channel 206 can be arranged in other configurations as may be required and/or desired in certain embodiments. When a negative pressure is applied to the exhaust port 110, fluid is drawn in from the subject interface 104 through the exhaust inlets 114 and channel 206 and out of the body member 102. In embodiments, the exhaust port 108 comprises apertures in the lid 200 and core 202 in fluid communication with the channel 206.

Figure 2C:
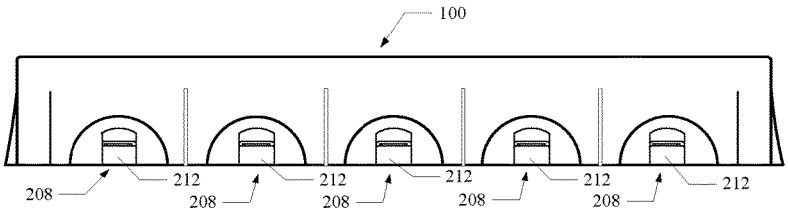
Figure 2D:
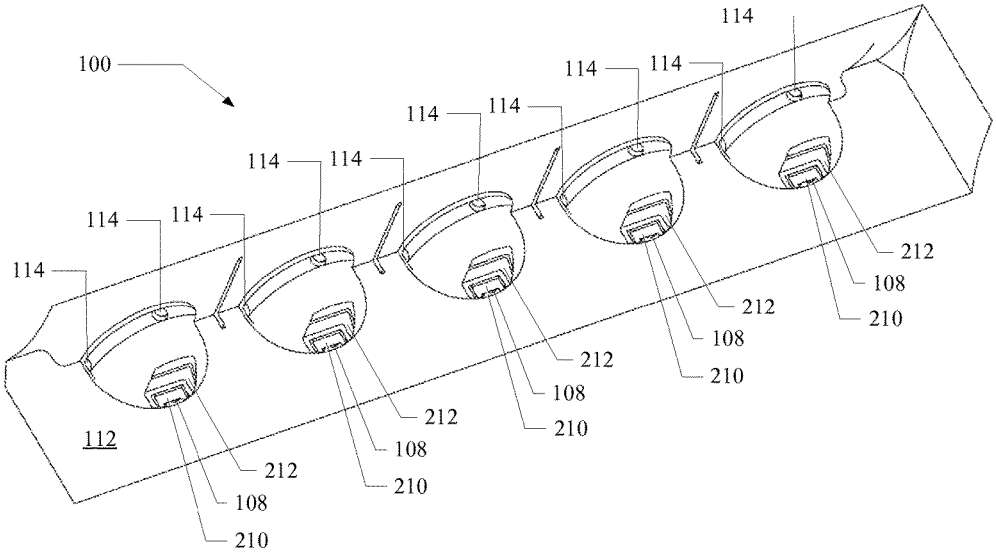

In embodiments, a diffuser 208 is disposed about the outlet 108 to aid in the mixing and dispersal of fluid within the subject interface 104. In certain embodiments, the diffuser 208 comprises an inner wall 210 and an outer wall 212, where each of the walls 210, 212 has a slit or aperture that allows the fluid to pass from the outlet 108 to the subject interface 104. Depending on the flow rate of the fluid at the outlet 108, the diffuser 208 can improve the efficiency of fluid scavenging. In the illustrated embodiment in FIGS. 2*b-d*, the inner wall 210 surrounds the outlet 108 on both the horizontal and vertical planes, leaving clearance below the horizontal plane. The inner wall 210 can be shaped to direct the flow of the fluid; for example, as shown in FIG. 2*b*, the inner wall 210 includes an angled slit that directs fluid flow vertically, rather than directing the flow directly out of the subject interface 104. In the illustrated embodiment, the outer wall 212 surrounds the inner wall. As one skilled in the art will appreciate, other diffuser configurations can be used as may be desired and/or required in certain embodiments. As shown, the slits or apertures in the walls 210, 212 can be offset to disperse the fluid within the subject interface 104. Dispersion reduces the potential for fluid to be propelled from the outlet 108 directly out of the subject interface 104 and increases the ability of the exhaust inlets 114 to scavenge the fluid.

Figure 3A:
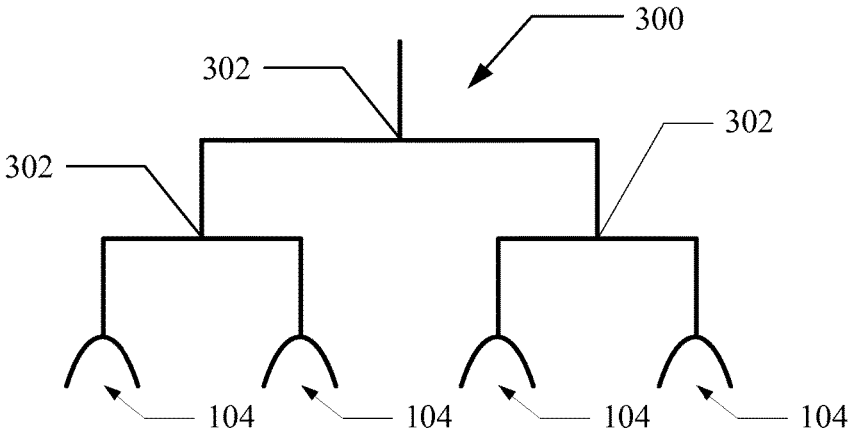
Figure 3B:
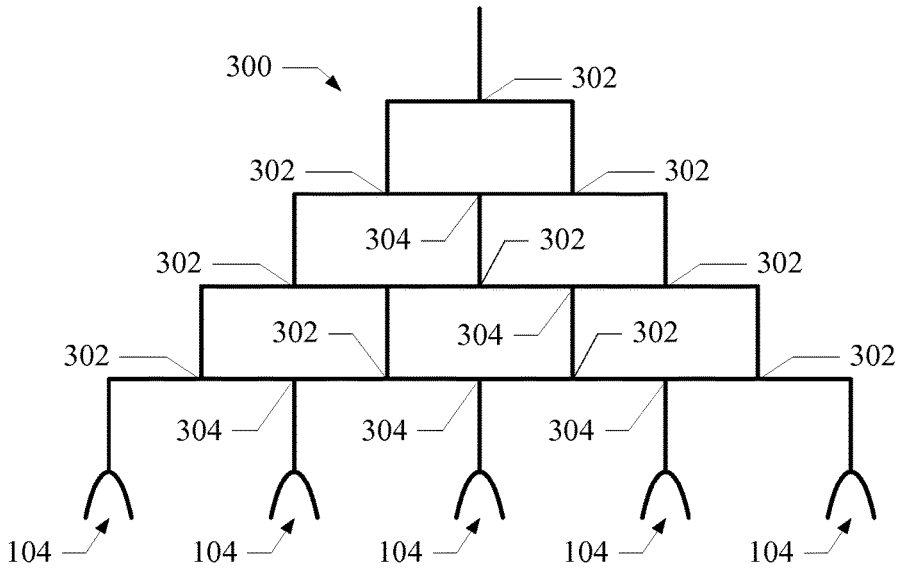

As shown schematically in FIGS. 3*a* and 3*b*, in embodiments, the lumina 300 are successively bifurcated until the desired number of subject interfaces 104 is reached. In embodiments, each lumen 300 is substantially the same in diameter, and the path length from the receiving port 106 to each of the subject interfaces 104 is substantially identical. Therefore, the resulting distribution of fluid is substantially equal between each subject interface 104. As shown, a bifurcation 302 can be implemented with a T-junction or any other configuration that facilitates even flow between both segments of the lumina 300 after the bifurcation 302. This even flow facilitates consistent delivery of fluid to the subject interfaces 104 and subject animals, reducing or eliminating problems of over and under delivery seen with other manifolds. Additionally, the even flow allows adjustment of the flow to every subject interface 104 simultaneously by adjusting the flow of the source.

For embodiments with an even number of subject interfaces 104, as shown in FIG. 3*a*, the lumina 300 are successively bifurcated until the desired number of subject interfaces 104 is reached.

For embodiments with an odd number of subject interfaces 104 greater than one, as shown in FIG. 3*b*, the lumina 300 are successively bifurcated and rejoined at bifurcation 302 and reconnection joints 304 until the desired number of subject interfaces 104 is reached. The reconnection joints 304 allow generally equal distribution of the fluid for an odd number of subject interfaces 104. For example, as shown in FIG. 3*a*, after the initial bifurcation 302, each segment of the lumina 300 splits in two secondary bifurcations 302 and four secondary segments. In contrast in FIG. 3*b*, at the reconnection joint 304 two of these secondary segments are rejoined to become a single secondary segment, ultimately resulting in three secondary sections. This pattern of bifurcation and rejoining of branches between closest hierarchal relative branches continues until the desired number of outputs 106, corresponding to the number of subject interfaces 104, is reached. The rejoined reconnection joints 304 are illustrated as T-junctions, but any configuration that facilitates the anastomosis of two lumina 300 would be suitable.

Fluid dynamics calculations were performed for a five subject interface model using Autodesk Simulation CFD 2015 with a flow rate of 2 L/min for gas input and 0 psi of internal pressure. The turbulence model used was k-epsilon. This yielded an equal flow rate and volume of 20% of the original at each of the five outlets.

Figure 3C:
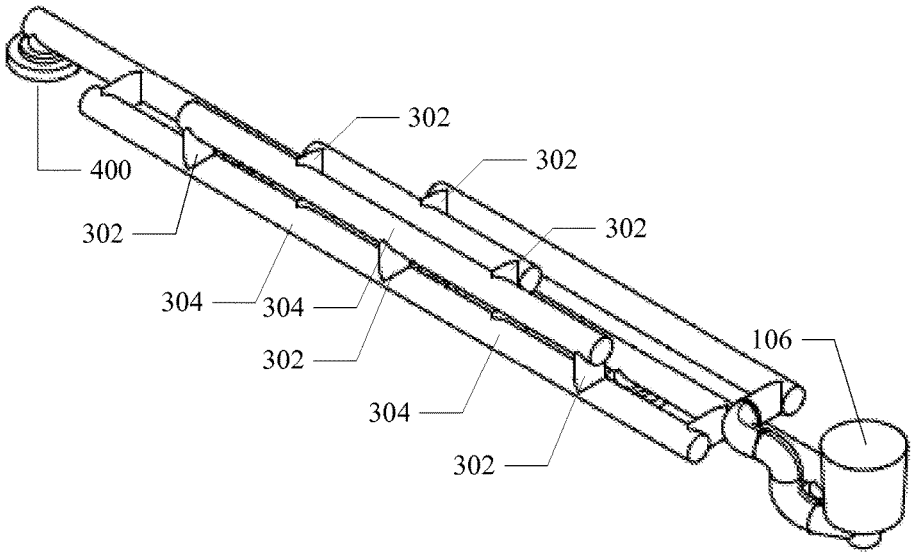
Figure 3D:
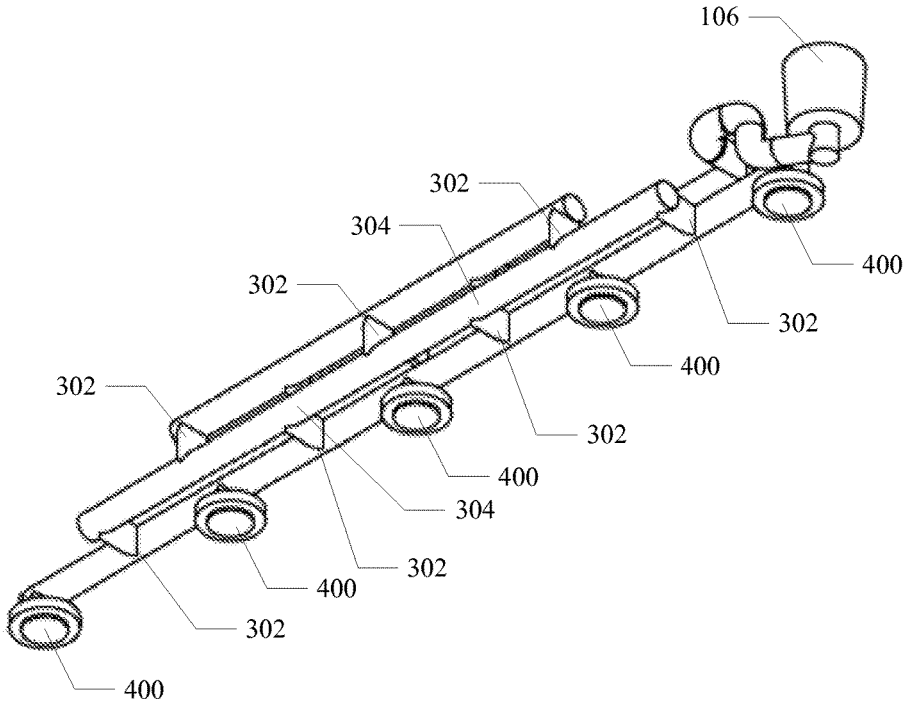

FIGS. 3*c* and 3*d*, show an illustrative arrangement of the lumina 300. For clarity, in these figures, only the walls of the lumina 300, the receiving port 106, and the mating cavity 400 are shown. In embodiments, the lumina 300 can be formed by any suitable means such as from tubing, or integrated into the body member 102 as voids as the manifold 100 is formed, for example, by 3D printing.

Figure 4:
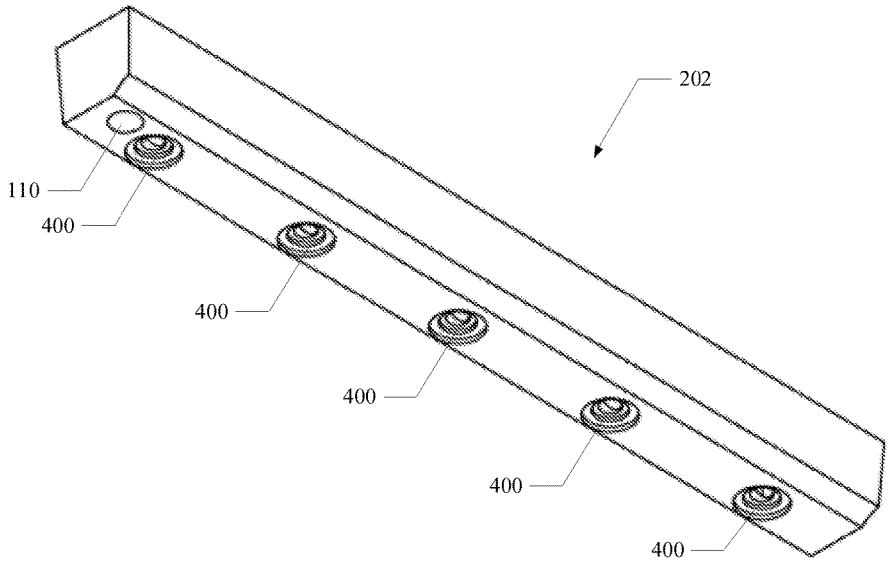
FIG. 4 shows an alternate perspective of the core shown in FIG. 2*a*.

As shown, fluid would enter the receiving port 106, flow through the lumina 300 to the approximate center of the body member 102 and then successively bifurcate and rejoin through the bifurcation 302 and reconnection points 304 until it exits a mating cavity 400, shown in FIG. 4, to transfer to the shell 204, and then to the subject interfaces 104 through the outlets 108.

Turning to FIG. 4, in embodiments where the body member 102 of the manifold 100 is comprised of multiple parts, the core 202 includes the mating cavity 400 in the lower surface of the core 202 for accommodating an O-ring to enhance the seal between the core 202 and the shell 204.

Figure 5:
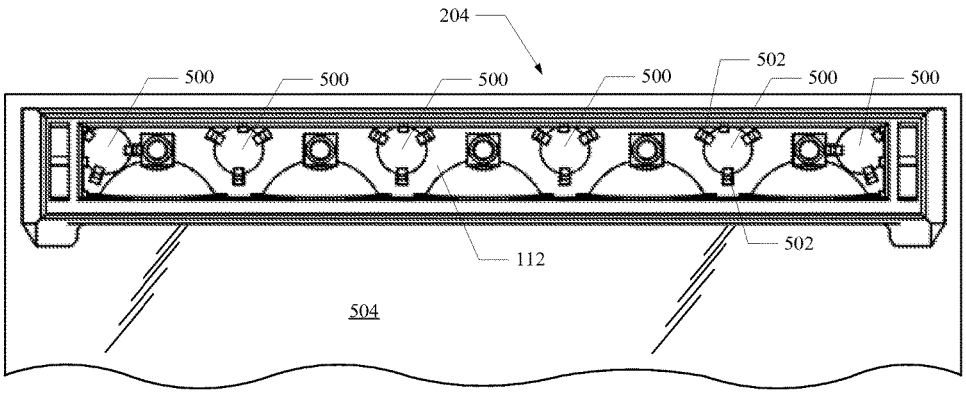
FIG. 5 shows a top view of the interior of the shell of the embodiment of FIG. 2*a*.

FIG. 5 shows a top view of an embodiment that utilizes magnets 500 to secure the body member 102 to a magnetic work surface or plate 504. In certain embodiments, magnets 500 can be incorporated in or near the base 112 of the body member 102. As one skilled in the art will understand, the magnets 500 may be installed in many ways as may be required and/or desired in certain embodiments. For example, in embodiments where the body member 102 is composed of multiple pieces, the magnets 500 can be affixed to the interior of the body member 102 by adhesive or physical hold-downs 502, as shown in FIG. 5. Magnets 500 can improve the seal between the base 112 of the body member 102 and a magnet compatible work surface or plate 504 by holding tight to the surface via magnetism. As used herein, "magnet compatible" refers to material capable of adhering to a permanent magnet, such as a paramagnetic or a ferromagnetic material. A tighter seal minimizes the escape of fluid from the subject interface 104 by reducing potential for fluid to leak between the support surface and the base 112 of the body member 102. Stronger magnets, such as rare earth magnets, can result in stronger magnetic attractions.

A transfer plate or plate 504, at least a portion of which is magnet compatible, can be useful when a magnet compatible work surface is not available (e.g. epoxy resin laboratory bench tops). Additionally, the plate 504 can be utilized to more easily prepare subject animals prior to insertion into an imaging apparatus. Once arranged, the plate 504, subject animals, and manifold 100 can be carried and inserted into the imaging apparatus.

Turning now to FIGS. 6*a-b*, an alternate arrangement of the lumina 300 is shown. Such an arrangement can allow for a more complex channel 206 arrangement, described below. For clarity, in these figures, only the walls of the lumina 300, the receiving port 108, and the mating cavity 400 are shown.

Turning now to FIGS. 6*c-d*, in an embodiment, the channel 206 comprises multiple sub-channels 600 through the core 202 that successively converge and diverge to eventually result in a single channel 206 in fluid communication with the exhaust port 110. The channel 206 is organized analogously to the lumina 300 to achieve a consistent draw from the exhaust inlets 114. In contrast to the lumina 300, the channel 206 moves the scavenged fluid from multiple exhaust inlets 114 to a single exhaust port 110. However, the even draw from the exhaust ports 114 pulls the fluid through the channel resulting in substantially even removal of the fluid from the subject interfaces 104. For clarity, in these figures, only the walls of the channel 206, the sub-channels 600, and the exhaust port 106 are shown.

FIG. 6*e* shows the lumina 300 and channel 206 of the same embodiments of FIGS. 6*a-d* packed together. For clarity, in this figure, only the walls of the lumina 300, the channel 206, the receiving port 106, exhaust port 106, and the mating cavity 400 are shown.

In embodiments, the receiving port 106 and the exhaust port 110 are threaded for receiving a threaded adapter.

FIG. 6*f* illustrates an embodiment of a core 202 including a channel 206 comprised of sub-channels 600 that provide an even draw from the exhaust ports 114.

Turning now to FIGS. 7 and 8, as will be appreciated by one having ordinary skill in the art, the size, number, and arrangement of subject interfaces 104 can be changed as is required and/or desired in certain embodiments. For example, FIG. 7 shows an embodiment that incorporates subject interfaces 104 on multiple sides of the body member 102. As shown, two opposite sides each have four subject interfaces 104. In another example, FIG. 8 shows an embodiment with one subject interface 104 in a triangular body member 102. Such an embodiment may be well-suited for placement in a corner. While depicted examples are generally rectangular or triangular, it will be appreciated that any suitable shape can be utilized, including but not limited to, curved, domed, or angled shapes.

FIG. 9 shows an embodiment wherein the body member 102 includes slots 900 located between adjacent subject interfaces 104. The slots 900 are capable of removably retaining dividers 902. In embodiments, the dividers 902 have at least a portion with complimentary shape and thickness to the slot 900 to allow a force fit between the divider 902 and body member 102. Dividers 902 provide physical barriers between specimens as may be desirable to prevent inter-specimen contact. As one skilled in the art will appreciate, the dividers 902 can be composed of materials either transparent or opaque to the imaging technique. Transparent materials can provide a physical barrier without interfering with imaging. Opaque materials can reduce the influence of potential inter-specimen light contamination. The removable design of the dividers 902 allows for efficient storage and easier cleaning.

Turning to FIG. 10, the outlet 108 can include a baffle 1000 to disperse the flow of fluid from the outlet 108. In the illustrated embodiment, the baffle 1000 is shown as a cross, but any suitable shape can be used. In embodiments, a baffle 1000 can be present alone, or in conjunction with a diffuser 208.

As an illustrative example, in operation in conjunction with an imaging apparatus, the subjects are first sedated in an induction chamber or by another method. Once sufficiently conditioned, the subjects are transferred to an imaging platform. Hose adapters connected to a source of fluid and a source of negative pressure are connected to the receiving port 106 and exhaust port 108, respectively and the fluid and negative pressure are adjusted as necessary. The fluid delivery manifold 100 can then be installed by aligning the subject interfaces 104 over the subjects' noses and placing the manifold 100 on the imaging platform.

In use, the flow rate of the vacuum is typically adjusted to be about ten-fold greater than the flow rate of the fluid delivery at the outlet 108. In lower fluid flow rate procedures, the flow rate of the vacuum is about five-fold greater than the flow rate of the fluid delivery at the outlet 108. In higher fluid flow rate procedures, the flow rate of the vacuum is about 15 to 20-fold greater than the flow rate of the fluid delivery at the outlet 108.

The rate of flow at each subject interface 104 is controlled simultaneously by adjusting the flow upstream from the fluid delivery manifold 100. Such adjustment can be accomplished by various means including, but not limited to, an anesthesia delivery system, a valve, or a flow regulator. When the number of subject interfaces exceeds the number of subjects, it is not necessary to block off the unused subject interfaces 104, because the negative pressure will draw any delivered fluid from the empty subject interfaces 104 regardless of the presence of a subject. This allows a desired flow rate to be maintained without having to adjust for the number of subjects present for a particular procedure.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations in form thereof are used in either the detailed description or the claims, such terms are intended to be inclusive in a manner similar to the term "comprising" as "comprising" is interpreted when employed as a transitional word in a claim.

What is claimed is:

1. A fluid delivery device for providing a fluid to at least one animal subject, comprising:

a body member, comprising:

a single receiving port that directs said fluid into said body member;

lumina connected to said receiving port, wherein the lumina branch at a bifurcation joint to form a first set of segments, and the first set of segments rejoin at a reconnection joint, resulting in a second set of segments having an odd number of segments, at least three subject interfaces configured to receive a portion of the animal subject, each having an outlet for discharging the fluid, the outlet connected to one of the second set of segments.

2. The fluid delivery service device as set forth in claim 1, wherein said subject interfaces are cavities in said body member.

3. The fluid delivery device as set forth in claim 1, wherein said body member has a substantially flat base;

said subject interface intersects said base; and wherein when said base abuts a work surface, the work surface forms a wall of the subject interface.

4. The fluid delivery device as set forth in claim 1, further comprising a diffuser interposed between said outlet and said subject interface.

5. The fluid delivery device as set forth in claim 4, wherein said diffuser comprises an inner wall with a first slit, and an outer wall with a second slit.

6. The fluid delivery device as set forth in claim 1, wherein said body member is of a material selected from the group consisting of acrylics, polyamides, polypropylene, and polyethylene.

7. The fluid delivery device as set forth in claim 1, further comprising:

a slot in said body member, wherein said slot is disposed between adjacent said subject interfaces; and at least one divider, wherein said divider is a flat plate having a thickness approximately equal to a width of said slot, and said slot capable of removably receiving and retaining said divider.

8. The fluid delivery device as set forth in claim 1 further comprising:

a magnet, and a cavity in a base of the body member, wherein said cavity is shaped for affixedly receiving said magnet.

9. The fluid delivery device as set forth in claim 8, further comprising a transfer plate, wherein at least a portion of said transfer plate is magnet compatible and the body member is configured to attach to said transfer plate via said magnet.

10. The fluid delivery device as set forth in claim 1, further comprising:

at least one exhaust inlet for collecting fluid;

an exhaust port for removing fluid from said body member, wherein the exhaust port is attached to said body member;

a channel connecting said exhaust inlet to said exhaust port capable of commuting fluids therebetween; and said at least one exhaust inlet being disposed within the interior of said subject interface.

11. The fluid delivery device as set forth in claim 10, wherein said at least one exhaust inlet is disposed within an inner perimeter of said subject interface.

12. The fluid delivery device as set forth in claim 1, wherein said subject interfaces are shaped to receive only the head of the animal subject.

13. The fluid delivery device as set forth in claim 1, wherein path lengths between the receiving port and each of the at least three subject interfaces via the lumina are approximately equal.

14. A fluid delivery device for providing a fluid to an animal subject comprising a body member, comprising:

a receiving port for directing fluid into said body member;

a lumen connected to said receiving port, wherein said lumen bifurcates at a bifurcation joint and rejoins via at least one reconnection joint to carry the fluid to an additional subject interface;

a subject interface, wherein said subject interface is a cavity within the body member for receiving a head of said animal subject and exposing said animal subject to the fluid, and wherein said lumen carries the fluid from said receiving port to said subject interface;

at least one exhaust inlet for collecting the fluid from said subject interface, wherein said at least one exhaust inlet is disposed within said subject interface;

a channel connected to said at least one exhaust inlet; and an exhaust port for removing fluid wherein said exhaust port is attached to said body member and said channel carries the fluid from said at least one exhaust inlet to said exhaust port.

15. A fluid delivery device for providing at least one fluid to at least one animal subject comprising a body member having an approximately rectangular shape;

said body member comprising:

a base;

a receiving port for directing fluid into said body member disposed on said body member;

an exhaust port for removing fluid wherein the exhaust port is disposed on said body member;

at least one subject interface located on said body member;

an outlet located within said subject interface;

a diffuser interposed between said at least one subject interface and said outlet;

a plurality of successively bifurcated and rejoined lumina connecting said receiving port to said outlet for evenly distributing the fluid to said at least one subject interface;

at least one exhaust inlet for collecting fluid;

a channel connecting said exhaust inlet to said exhaust port;

a divider;

said body member having a slot disposed between two adjacent said subject interfaces capable of removably receiving and holding said divider;

said divider being a being a flat plate having a thickness equal to a width of said slot;

at least one rare-earth magnet disposed in said base;

wherein said plurality of subject interfaces are cavities in said body member; and wherein said at least one exhaust inlet is disposed within an inner perimeter of said at least one subject interface.

* * * * *